United States Patent [19]

Cowles

[11] 4,016,889

[45] Apr. 12, 1977

[54] HAIRPIECE

[76] Inventor: Mary M. Cowles, 529 Ross Drive, Escondido, Calif. 92025

[22] Filed: Feb. 21, 1975

[21] Appl. No.: 551,899

[52] U.S. Cl. ..... 132/56

[51] Int. Cl.[2] ..... A41G 3/00

[58] Field of Search ..... 132/53, 54, 56, 9

[56] References Cited

UNITED STATES PATENTS

| | | | |
|---|---|---|---|
| 125,382 | 4/1872 | Cutter | 132/53 |
| 816,969 | 4/1906 | Delavan | 132/53 |
| 1,133,196 | 3/1915 | Teugler | 132/54 |
| 1,199,144 | 9/1916 | Zak | 132/53 |
| 2,574,558 | 11/1951 | Graber et al. | 132/53 |
| 3,495,603 | 2/1970 | Young, Jr. | 132/53 |

*Primary Examiner*—G.E. McNeill
*Attorney, Agent, or Firm*—Joseph R. Dwyer

[57] ABSTRACT

A hairpiece in the form of an elongated strip of natural or synthetic hair adapted to be attached to a woman's natural hair to form bangs, either alone or with a woman's existing bangs to provide a fuller look, to provide a more pleasing effect, and to permit changing of existing hairdo's to one with bangs or one without bangs as desired.

2 Claims, 7 Drawing Figures

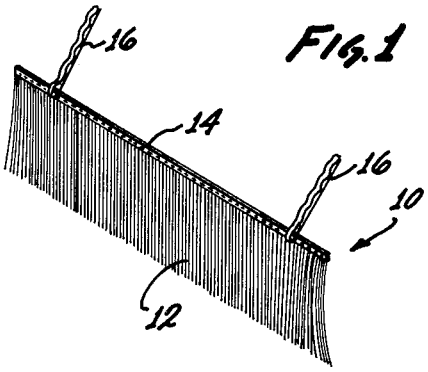
FIG. 1
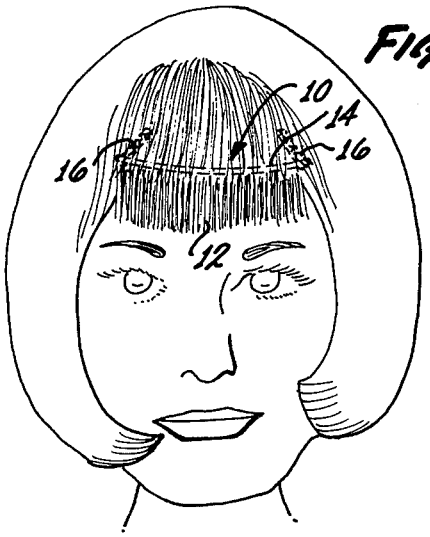
FIG. 2
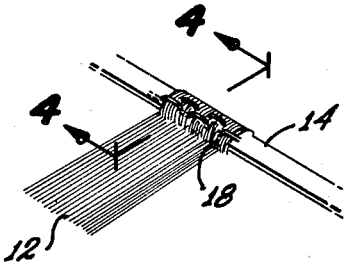
FIG. 3
FIG. 4
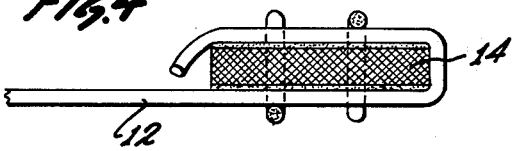
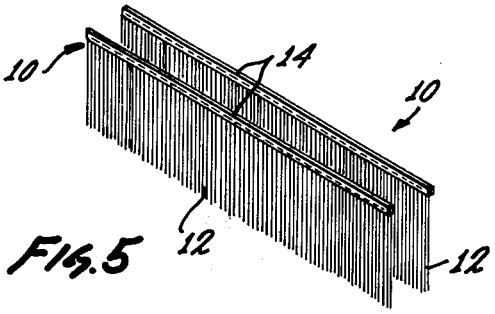
FIG. 5
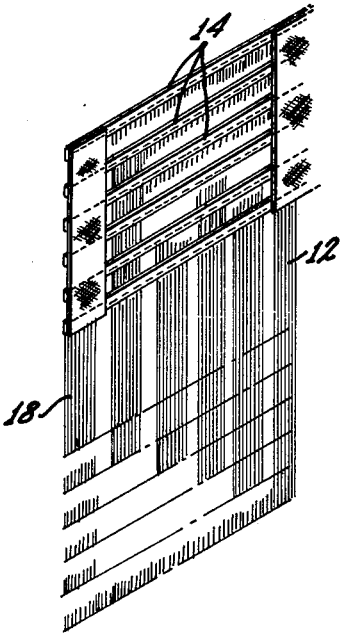
FIG. 6
FIG. 7
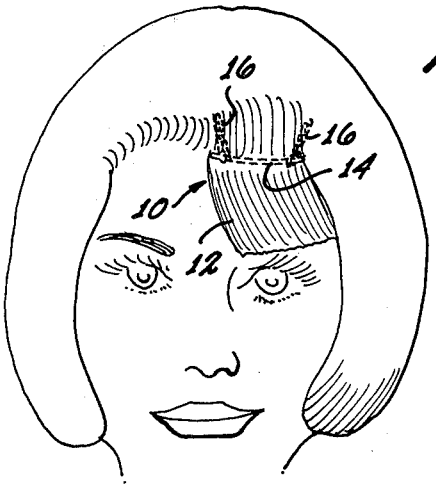

HAIRPIECE

BACKGROUND OF THE INVENTION

The use of wigs and wiglets of natural or synthetic hair in connection with a woman's natural hair to supplement the natural hair and to provide a specific hairdo are old and well-known. Examples of these are the full wigs that are worn completely over the head, and pieces of hair in the form of a knot or bun have been utilized.

However, heretofore there was no good way in which a woman who wished to do so could change her hairdo so as to provide for bangs or to supplement her existing bangs for a more full and pleasing look. This is because the present or existing hairpieces are directed to either a full wig or the supplementation of hair on the top of the head without much attention having been paid to the bangs.

SUMMARY OF THE INVENTION

My invention fulfills the existing need for a hairpiece or wig for a woman to use to provide bangs where none have been used before in the event she wishes to change her hairdo, or to supplement her existing bangs with an additional amount so as to provide a more pleasing effect.

This is accomplished by my invention by providing an elongated strip of natural or synthetic hair suitably affixed to a band or piece of fiber, or the like, of sufficient strength to provide support for the hair of an elongated strip. This strip with the attached hair forming the bangs may be connected to the existing hairdo in any suitable manner as by bobby pins, and may be utilized with the existing bangs if desired. Also, a number of such hairpieces can be used at once for full hair effect if desired.

It is therefore a principal object of my invention to provide a bang-type hairpiece that overcomes the deficiencies of the existing wigs and wiglets.

It is another object of my invention to provide a bang for use with hairdos which is simple and inexpensive to fabricate.

It is still another object of my invention to provide a hairpiece that can be used with existing bangs to supplement and beautify the existing bangs or that can be used with an existing hairdo by adding bangs, thus permitting a change of hairdo as desired.

BRIEF DESCRIPTION OF THE DRAWINGS

FIG. 1 is a perspective view showing the hairpiece in the form of bangs constructed in accordance with the teachings of my invention;

FIG. 2 shows the utilization of my invention in combination with a natural hairdo;

FIG. 3 illustrates another method of connecting the hair to a band to form the invention;

FIG. 4 is an enlarged detail view of the manner of connecting the hairpiece to the band;

FIG. 5 is a perspective view, somewhat similar to FIG. 1 but showing the utilization of two such bangs for a full look;

FIG. 6 shows the manner in which several bangs can be utilized in one strip to give a very full look; and FIG. 7 shows the use of half-size bangs for only one side of the face.

DESCRIPTION OF THE PREFERRED EMBODIMENT

Turning now to FIG. 1, it can be seen that there is shown a hairpiece comprising my invention, indicated in its entirety as 10, which may be used to form bangs by connecting to an existing hairdo, such as shown in FIG. 2. The hairpiece 10 comprises a plurality of natural or synthetic hair 12 of generally uniform length and of any selected color to match the hairdo and suitably attached to a strip or band formed of fiber or fiber-like material.

In the embodiment disclosed in FIGS. 1–6, the strip 14 of material is of a length sufficient to form bangs over the forehead, such as shown in FIG. 2, so as to be conveniently attached to the hairdo in any suitable manner, such as with bobby pins 16 and preferably long enough to tuck the ends of the hairpiece beneath the existing hairdo. The band 14 is also chosen to be of sufficient strength to remain substantially straight, such as shown in FIG. 1, yet easily yieldable to fit the contour of the forehead.

Turning now particularly to FIGS. 3 and 4, it can be seen that the band is preferably formed by forming strands 18 of hair 12 around a relatively flat band and binding the same by sewing thread over the strands and gluing the strands and thread to the band so as to form a final strip or band.

Thus formed, it is within the scope of my invention to utilize one or more such pieces, such as in FIGS. 5 and 6 where a more fuller look is desired.

For example, FIG. 6 shows a number of such hairpieces 10 held together in any suitable manner, as by sewing or gluing to a pair of vertical strips of cloth or the like so as to provide a very full look to the bangs if desired.

FIG. 7 shows various modifications that can be made within the scope of the invention as, for example, the band is shortened so that bangs only on one side of the face may be added to the existing hairdo.

From the foregoing it can be seen that I have provided a hairpiece in the form of bangs which is suitable for a number of uses depending upon the effect desired, i.e., to supplement any existing bangs, or to provide a hair-do with bangs where none was before, or as shown in FIG. 7, to use half-bangs for an existing hairdo.

Finally, it should be pointed out that my invention can be utilized with existing full wigs by attaching the same as by bobby pins as taught above if it were desired to change the look of an existing wig.

Obviously, many variations and modifications of the foregoing can be used, once having understood the teachings of this invention. There are no limitations to the variations that can be produced to fit all bang styles, thick, thin, long, short, shag, straight, curly and of any length or width worn as one piece or separated, in all colors and textures.

What is claimed is:

1. A hairpiece for forming bangs on an existing hairdo or to supplement existing bangs of an existing hairdo comprising;

a relatively flat band of a length sufficient to support a number of strands of hair in a planar fashion of a sufficient amount to provide bangs to an existing hairdo, said band being yieldable and formable across the contour of the forehead, hair means permanently bound by sewing and glueing and forming a bang of a sufficient width with a sufficient number of hair strands to selectively form a bang, a plurality of such bands being substantially parallel with one another such that said strands are overlapping and with said bands being connected together by suitable vertical strips at least on each end of said bands with said strips being substantially perpendicular to said bands to provide a more fuller and pleasing look for the bang, and means forming part of at least one of said bands to enable the hairpiece to be attached to the existing hairdo; and said bangs so attached forming a full or partial bang for a more pleasing effect for the hairdo.

2. The hairpiece as claimed in Claim 1 wherein the band is only of sufficient width to form a half-bang across only a portion of the forehead.

* * * * *